US008418265B1

(12) United States Patent
Storms, Jr. et al.

(10) Patent No.: US 8,418,265 B1
(45) Date of Patent: Apr. 16, 2013

(54) RELEASABLE VEST

(75) Inventors: Frederick W. Storms, Jr., Newport News, VA (US); Eric M. Yeates, Virginia Beach, VA (US); Thomas A. Marx, Virginia Beach, VA (US)

(73) Assignee: Alliant Techsystems Inc., Minneapolis, MN (US)

( * ) Notice: Subject to any disclaimer, the term of this patent is extended or adjusted under 35 U.S.C. 154(b) by 1632 days.

(21) Appl. No.: 11/895,718

(22) Filed: Aug. 27, 2007

Related U.S. Application Data

(60) Provisional application No. 60/840,257, filed on Aug. 25, 2006.

(51) Int. Cl.
*A41D 1/04* (2006.01)

(52) U.S. Cl.
USPC ..... 2/102; 2/2.5

(58) Field of Classification Search ..... 2/2.5, 92, 2/94, 102, 456, 462, 463, 465, 467
See application file for complete search history.

(56) References Cited

U.S. PATENT DOCUMENTS

| | | | | |
|---|---|---|---|---|
| 5,060,314 | A * | 10/1991 | Lewis | 2/2.5 |
| 5,073,985 | A * | 12/1991 | Stone et al. | 2/2.5 |
| 6,185,738 | B1 * | 2/2001 | Sidebottom | 2/2.5 |
| 2005/0005343 | A1 * | 1/2005 | Johnson | 2/102 |

* cited by examiner

*Primary Examiner* — Katherine Moran
(74) *Attorney, Agent, or Firm* — Wooten & Shaddock, PLC

(57) ABSTRACT

A releasable vest having a first panel, at least one shoulder strap element having at least one shoulder strap element attachment opening, a first waist belt element having at least one waist belt element attachment opening, a second waist belt element having at least one an attachment loop that is capable of being aligned with and passed through a waist belt attachment opening of the first waist belt element and a shoulder strap element attachment opening of the at least one shoulder strap element, a second panel, and a release lanyard that is capable of releasably securing the first waist belt element and the at least one shoulder strap element to the attachment loop.

28 Claims, 7 Drawing Sheets

RELEASABLE VEST

CROSS-REFERENCE TO RELATED APPLICATIONS

This nonprovisional patent application claims the benefit of U.S. Provisional Patent Application Ser. No. 60/840,257, filed Aug. 25, 2006, the disclosure of which is incorporated herein by reference.

BACKGROUND OF THE INVENTION

1. Field of the Invention

This invention relates generally to releasable vests or carriers. In particular, the present invention relates to an improved releasable vest or carrier that is easier to operate by a user and has components that, upon release, are more likely to separate and fall away from the user than current releasable or cutaway vests.

2. Description of Related Art

Military and law enforcement personnel, particularly those attached to special operations unit, carry a large amount of specially designed and adapted gear on various vests or carriers. Because of the bulk and weight of certain tactical vests and body armor carriers, it is sometimes necessary or desirable to be able to quickly remove the vest or carrier, particularly in an emergency situation.

SUMMARY OF THE INVENTION

However, current releasable or cutaway vests typically include a multitude of components or panels that are connected via a plurality of release cords that are intricately woven between the components in order to keep the components connected.

The release cords typically comprise metal or plastic cords with a circular cross-section. Unfortunately, if a load is placed on the vest in an area above the location of one of the cords, a pressure point can be formed, making the vest uncomfortable for the wearer of the vest.

In order for the various components or panels of a known, assembled cutaway vest to be released, the wearer must pull the release cord(s) a sufficient distance such that the release cord becomes unwoven from the various components and releases each of the components. This is typically difficult as there is a great deal of friction between the release cord(s) and the cutaway vest components. Furthermore, the release cord (s) typically has/have to be pulled a great distance in order to fully release the cutaway vest components.

In many of the current cutaway vests, even after the release cord(s) has/have been removed from the vest, the vest components remain coupled to one another via various attachments, such as Velcro. Thus, the "released" components must still be manually separated from one another before the cutaway vest can be removed from the user.

Therefore, the present invention relates generally to releasable vests or carriers that are easier to operate by a user and have components that, upon release, are more likely to separate and fall away from the user than current cutaway vests.

In various exemplary, non-limiting embodiments, the releasable vest or carrier comprises at least some of a front panel, a back panel, and at least one waist belt element extending from or coupled to either the front panel or the back panel. A flexible release lanyard is used in combination with an attachment loop, such that when various components of the releasable vest or carrier are assembled, the components can be maintained in an assembled relationship. When the flexible release lanyard is pulled a predetermined distance, select components of the releasable vest or carrier are released from the assembled relationship and can fall away from the user.

In various exemplary, non-limiting embodiments, an additional safety lanyard may be included. In these exemplary embodiments, at least some of the components of the releasable vest or carrier cannot be released from the assembled relationship until both the safety lanyard and the release lanyard are pulled a predetermined distance.

In various exemplary, non-limiting embodiments, certain of the components of the releasable vest or carrier are released from the assembled relationship when the release lanyard is pulled a first predetermined distance. When the release lanyard is pulled a second predetermined distance, certain remaining components of the releasable vest or carrier are released from the assembled relationship.

Accordingly, this invention provides a releasable vest of improved design.

This invention separately provides a vest, which is capable of allowing a user to more efficiently release, or "cut away", the vest.

This invention separately provides a releasable vest, which, in certain exemplary embodiments, is capable of providing an increased level of security against accidental release.

These and other features and advantages of this invention are described in or are apparent from the following detailed description of the exemplary embodiments.

BRIEF DESCRIPTION OF THE DRAWINGS

The exemplary embodiments of this invention will be described in detail, with reference to the following figures, wherein like reference numerals refer to like parts throughout the several views, and wherein.

DETAILED DESCRIPTION OF EXEMPLARY EMBODIMENTS

Figure 1:
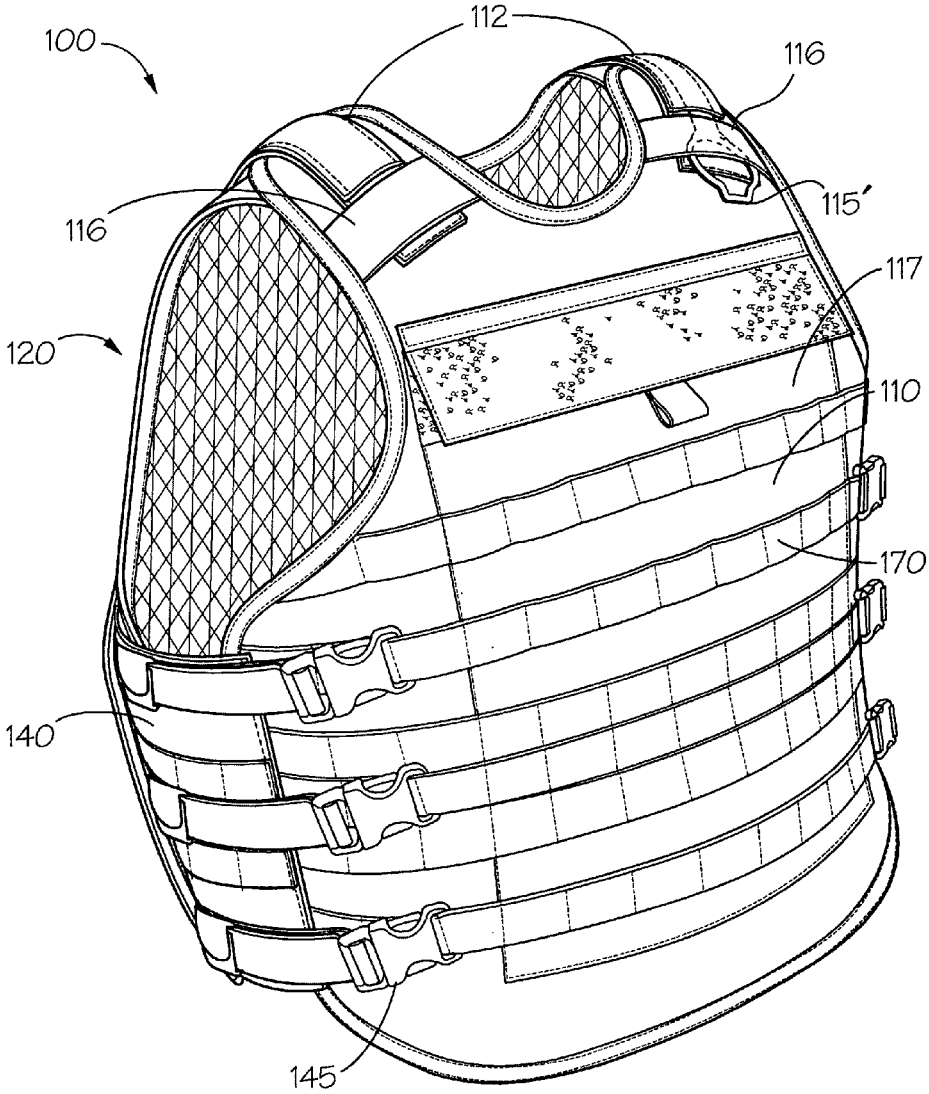
FIG. 1 shows a front perspective view of a first exemplary embodiment of a releasable vest according to this invention.
Figure 2A:
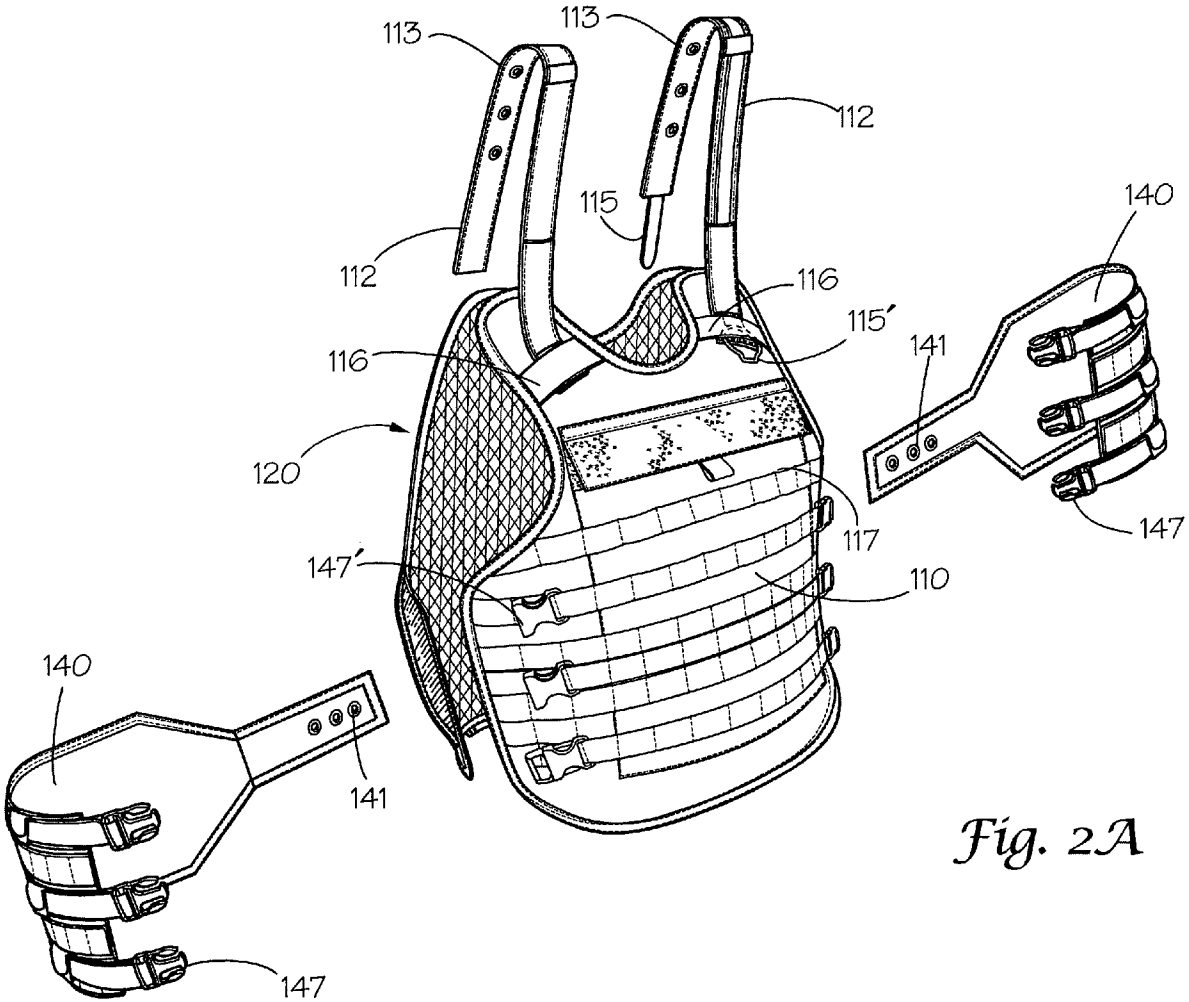
FIG. 2A shows an exploded front perspective view of a first exemplary embodiment of a releasable vest according to this invention.
Figure 2B:
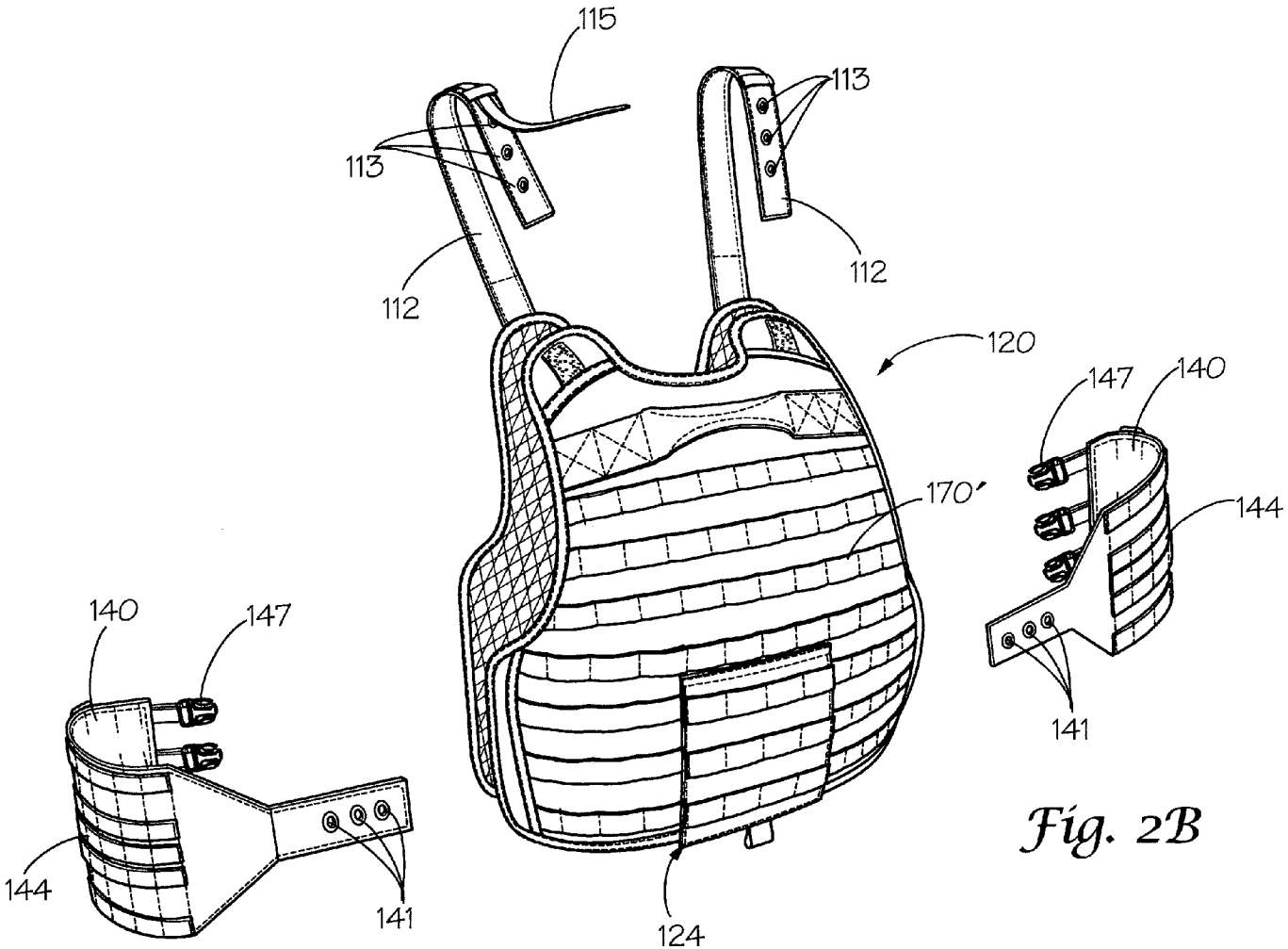
FIG. 2B shows an exploded rear perspective view of a first exemplary embodiment of a releasable vest according to this invention.
Figure 3A:
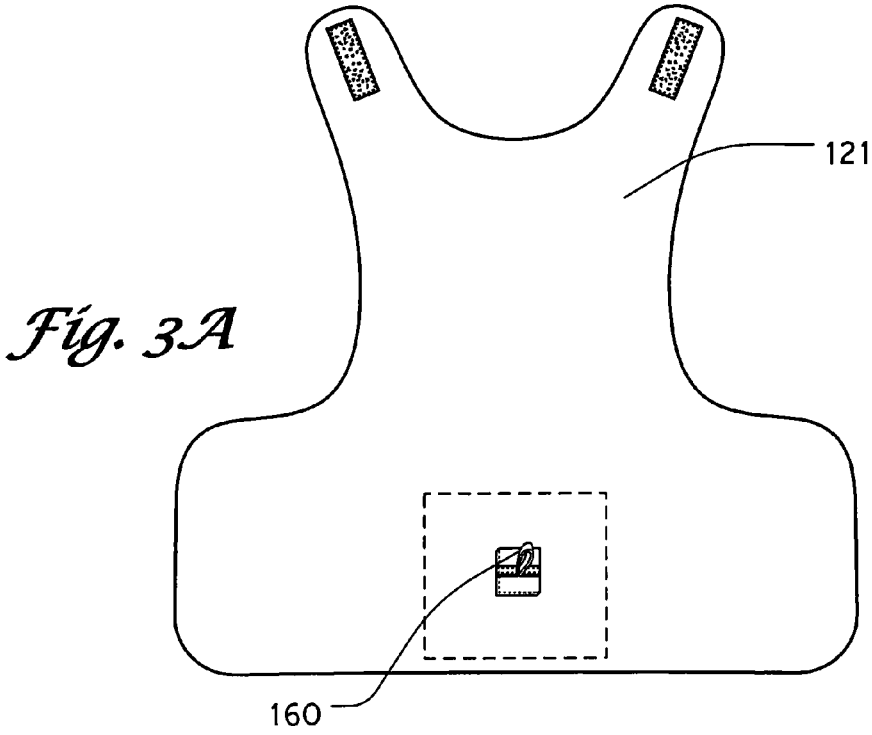
FIG. 3A shows a rear view of the first layer of the back panel of a first exemplary embodiment of a releasable vest according to this invention, wherein the access flap is in a closed position.
Figure 3B:
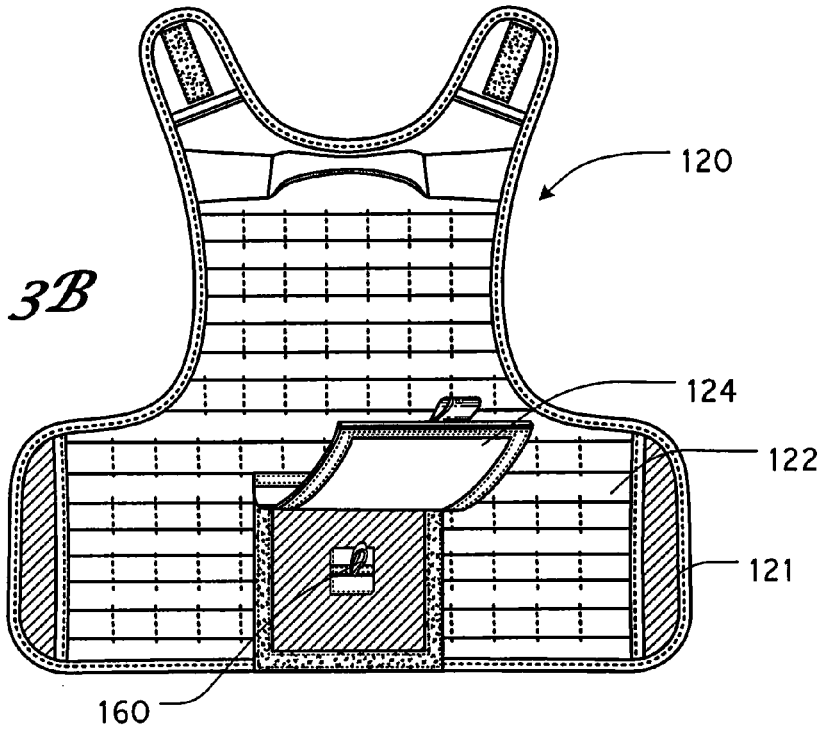
FIG. 3B shows a rear view of the back panel of a first exemplary embodiment of a releasable vest according to this invention, wherein the access flap is in an open position.

For simplicity and clarification, the design factors and operating principles of the releasable vest of this invention are explained with reference to various exemplary embodiments of a releasable vest according to this invention. The basic explanation of the design factors and operating principles of the releasable vest is applicable for the understanding, design, and operation of the releasable vest of this invention.

It should also be appreciated that, for simplicity and clarification, the embodiments of this invention will be described using the terms "front" and "back". However, it should be understood that these terms are merely used to aid in understanding of this invention are not to be construed as limiting the systems, methods, apparatuses, and applications of this invention. Thus, it should be appreciated that the design factors and operating principles of the releasable vest described herein may be used in a "mirror image" releasable vest, where in the elements described as being included in or on the front are included in or on the back. Alternatively certain of the elements that are described as being included in or on the back of the releasable vast may be included in or on the front of the vest, or vice versa.

Furthermore, it should be appreciated that, for simplicity and clarification, the embodiments of this invention will be shown and/or described with reference to MOLLE and/or S.T.R.I.K.E. compatible webbing being included on various portions of the releasable vest. However, it should be appreciated that the inclusion and/or placement of any MOLLE and/or S.T.R.I.K.E. compatible webbing is not essential to the releasable vest of this invention. In various exemplary, non-limiting embodiments of this invention, the releasable vest may incorporate any type of known or later developed system capable of allowing any number of exterior pouches, pockets, carriers, or the like to be permanently or releasably coupled or attached to the vest. Alternatively, the design factors and principles of this invention may be utilized in a vest that does not include any exterior pouches, pockets, or carriers, but is used as, for example, a ballistic plate carrier or a floatation device.

It should also be appreciated that the terms "releasable vest", "vest", and "carrier" are used for basic explanation and understanding of the operation of the systems, methods, apparatuses, and applications of this invention. Therefore, the terms "releasable vest", "vest", and "carrier" are not to be construed as limiting the systems, methods, apparatuses, and applications of this invention.

Turning now to the drawing figures, FIGS. 1 through 4 show various features of a first exemplary embodiment of a releasable vest according to this invention. As shown in the drawing figures, the releasable vest 100 includes at least some of a front panel 110, front shoulder strap elements 112, a back panel 120, waist belt elements 140, an attachment loop 160, and a release lanyard 115.

The front panel 110 includes two front shoulder strap elements 112 that extend from an upper portion of the front panel 110. In various exemplary embodiments, the front shoulder strap elements 112 are formed as an integral part of the front panel 100. Alternatively, the front shoulder strap elements 112 may be coupled or attached to the front panel 110.

In various exemplary embodiments, each of the front shoulder strap elements 112 includes a plurality of front shoulder strap attachment openings 113. In various exemplary, non-limiting embodiments, the front shoulder strap attachment openings 113 comprise slits or openings formed through the material of the front shoulder strap elements 112. In certain exemplary embodiments, the attachment openings 113 are reinforced by, for example, stitching, a grommet, or other reinforced eyelet.

The front shoulder strap attachment openings 113 allow the attachment loop 160 to pass through the front shoulder strap elements 112 (as discussed below). In various exemplary embodiments, a single attachment opening 113 may be included on each front shoulder strap element 112. However, a plurality of attachment openings 113 may be included to allow a user to select a single attachment opening 113 to pass the attachment loop 160 through, thereby providing a measure of adjustment to the effective length of the front shoulder strap elements 112 and the overall fit of the releasable vest 100.

In various exemplary embodiments, a back panel 120 comprises at least a first layer 121 and a second layer 122, with a cavity or tunnel formed between the first layer 121 and the second layer 122. An upper portion of the second layer 122 is attached or coupled to the first layer 121 at an upper portion of the first layer 121 and a lower portion of the second layer 122 is attached or coupled to the first layer 121 at a lower portion of the first layer 121. In this manner, at least a portion of the front shoulder strap elements 112 and the waist belt elements 140 can be introduced into an interior of the back panel 120.

Alternatively, the back panel 120 may comprise a single sheet of material, at least a portion of which has been separated to form at least one interior tunnel or cavity.

In various exemplary embodiments, the back panel 120 may also comprise an additional layer of material, which provides an additional cushioning or air flow layer to the back panel 120.

The waist belt elements 140 serve to couple the front panel 110 to the back panel 120. As illustrated in the drawing figures, the waist belt elements 140 may be releasably coupled or attached to the front panel 110, via waist belt attachment/adjustment elements 145.

Each of the waist belt attachment/adjustment elements 145 comprises a mating pair of coupling elements, a male coupling element 147 and a corresponding female coupling element 147', proximate a first end of the waist belt elements 140. The male coupling element 147 and the female coupling element 147' may be releasably coupled.

The female coupling element 147' is releasably or permanently coupled or attached to the front panel 110, while the male coupling element 147 is releasably or permanently coupled or attached to the waist belt element 140. In this manner, when the male coupling element 147 and the female coupling element 147' are coupled, the front panel 110 is coupled to the waist belt element 140.

In various exemplary embodiments, each of the male coupling elements 147 is secured to an extended web portion of the MOLLE and/or S.T.R.I.K.E. compatible accessory mounting portion 144 of the waist belt element 140 that forms a strap element 142.

As illustrated herein, an excess portion of the strap element 142 can be secured to the MOLLE and/or S.T.R.I.K.E. compatible accessory mounting 144 via a strap-securing element 143. In various exemplary embodiments, the strap securing element 143 comprises a length of hook-and-loop fastener, such as, for example, Velcro, which can be attached to an end of the strap element 142 perpendicular to a longitudinal axis of the strap element 142. The strap-securing element can then be woven through the webbing of the MOLLE and/or S.T.R.I.K.E. compatible accessory mounting 144 and overlapped upon itself to secure the end of the strap element 142 to the webbing.

As also illustrated herein, each of the female coupling elements 147' is secured to a MOLLE and/or S.T.R.I.K.E. compatible accessory mounting portion 170 of the front panel 110. In various exemplary embodiments, the female coupling element 147' may be removably attachable to a MOLLE and/or S.T.R.I.K.E. compatible accessory mounting portion 170 of the front panel 110 through use of an attachment opening 148. If included, the attachment opening 148 allows the female coupling element 147' to be secured to a portion of the webbing of the MOLLE and/or S.T.R.I.K.E. compatible accessory mounting portion 170, after the webbing has been secured to the front panel 110.

As further illustrated herein, the waist belt elements 140 comprises a sufficient length of strap element 142 and includes appropriate hardware such that the effective length of the waist belt elements 140 relative to the front panel 110 may be adjusted to provide an additional measure of adjustment to the overall fit of the releasable vest 100.

It should be appreciated that, although the waist belt elements 140 are shown as being secured to the front panel 110 via waist belt attachment/adjustment elements 145, the waist belt elements 140 may be removably or permanently secured to the front panel 110 via any known or later developed means for securing the waist belt elements 140 to the front panel 110. For example, the waist belt elements 140 may be secured to the front panel 110 via male/female snap-release buckles, Velcro or other hook-and-loop fasteners, buttons, rivets, snaps, or other known or later developed fastening means.

In various exemplary embodiments, not illustrated herein, the strap element 142 may be of a predetermined length and/or the waist belt elements 140 may be formed as an integral part to the front panel 110 and merely extend from the front panel 110. In these exemplary embodiments, at least a portion of the integral waist belt elements 140 and/or the strap element 142 may include a flexible or elastic portion to allow for a measure of expansion of the waist belt elements 140 so that the waist belt elements 140 can expand to make the releasable vest 100 easier for a user to don.

In various exemplary embodiments, each of the waist belt elements 140 includes a plurality of waist belt attachment openings 141. In various exemplary, non-limiting embodiments, the waist belt attachment openings 141 comprise slits or openings formed through the material of the waist belt elements 140. In certain exemplary embodiments, the waist belt attachment openings 141 are reinforced by, for example, stitching, a grommet, or other reinforced eyelet.

The waist belt attachment openings 141 allow the attachment loop 160 to pass through the waist belt elements 140 (as discussed below). In various exemplary embodiments, a single attachment opening 113 may be included on each waist belt attachment opening 141. However, a plurality of waist belt attachment openings 141 may be included to allow a user to select a single waist belt attachment opening 141 to pass the attachment loop 160 through, thereby providing a measure of adjustment to the effective length of the waist belt elements 140 and the overall fit of the releasable vest 100.

The attachment loop 160 comprises a loop made of a fabric, metallic, plastic, or composite material. In various exemplary embodiments, the attachment loop 160 is attached or coupled to the second layer 122 of the back panel 120. Alternatively, the attachment loop 160 may be coupled to the second layer 122 by being passed through and captured at least partially within a hole or slit formed in the second layer 122.

The release lanyard 115, as partially illustrated in FIGS. 26 and 27, comprises an elongate piece of material having a relatively thin profile. By utilizing a release lanyard 115 having a relatively thin profile, the possibility of the release lanyard 115 producing a pressure point on the user is greatly reduced. However, it should be appreciated that the release lanyard 115 may have a round or oval shaped profile. In various exemplary embodiments, the release lanyard 115 comprises a material having a relatively low coefficient of drag.

In various exemplary embodiments, the release lanyard 115 may comprise a single piece of material that extends from a pull handle 115' to a terminal end. Alternatively, the release lanyard 115 may comprise a variety of materials that are attached or coupled together to form the release lanyard 115. For example, the elongate body portion of the release lanyard 115 may be comprised of a different material from a pull handle 115'.

In various exemplary embodiments, a portion of the exterior of the front panel 110, the back panel 120, and/or the waist belt elements 140 includes MOLLE and/or S.T.R.I.K.E. compatible webbing. However, it should be appreciated that the inclusion of any such MOLLE and/or S.T.R.I.K.E. compatible webbing is a design choice based on the desired appearance and functionality of the releasable vest 100.

In various exemplary embodiments, the front panel 110, the back panel 120, and/or the waist belt elements 140 may include a pocket or plate carrier, such as, for example, the front pocket 117. However, it should be appreciated that the inclusion of any such pocket or plate carrier is a design choice based on the desired appearance and functionality of the releasable vest 100. If a pocket is included, one or more grommets may be included to provide drainage for each of the pockets.

One optional method for assembling the elements of the releasable vest 100 includes first securing the waist belt elements 140 to the front panel 110, as discussed above.

Then, a second end of a first waist belt element 140 is introduced into an interior tunnel or cavity of the back panel 120 and passed through the tunnel or cavity of the back panel 120 such that the attachment loop 160 can be aligned with and passed through an appropriate waist belt attachment opening 141.

Figure 4:
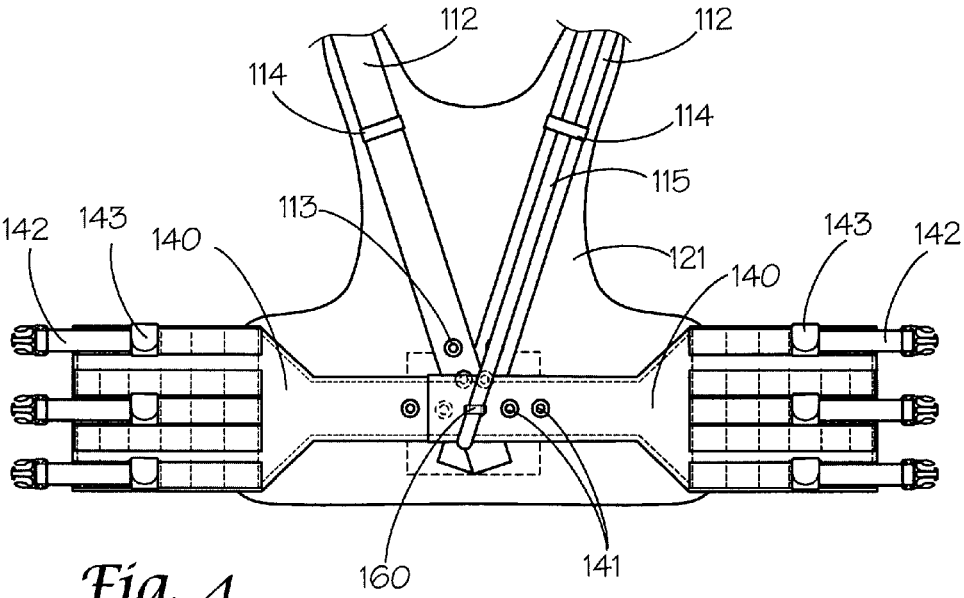
FIG. 4 shows an interior view of the back panel of a first exemplary embodiment of a releasable vest according to this invention, illustrating the releasable coupling of the waist belt elements according to this invention.

As illustrated in FIG. 4, when an appropriate waist belt attachment opening 141 has been aligned with the attachment loop 160, the attachment loop 160 is passed through the aligned waist belt attachment opening 141.

It should be appreciated that access to the attachment loop 160 is provided by the access panel 124 formed in the back panel 120.

In various exemplary embodiments, as illustrated herein, the access panel 124 is formed in a side of the back panel 120 that faces away from the body of a user wearing the releasable vest 100. Alternatively, the access panel 124 may be formed on a side of the back panel 120 that faces toward the body of a user wearing the releasable vest 100.

The access panel 124 may be secured in place by a releasable coupling means 126. In various exemplary embodiments, the releasable coupling means comprises a hook and loop fastener, such as Velcro. It should be appreciated that, in various exemplary embodiments the releasable coupling means 126 may comprise other releasable coupling means or releasable fasteners, such as, for example, male/female snap-release buckles, a ziplock fastening device, a zipper, buttons, snaps, or other fastening, closure, or attachment means known by those skilled in the art.

Once the attachment loop 160 has been passed through a waist belt attachment opening 141 of a first waist belt element 140, a second end of a second waist belt element 140 is passed through an interior tunnel or cavity of the back panel 120 and the attachment loop 160 is passed through an appropriately aligned waist belt attachment opening 141 of the second waist belt element 140.

Next, an end of a first front shoulder strap element 112 is introduced into an interior tunnel or cavity of the back panel 120 and passed through the tunnel or cavity of the back panel 120 such that the attachment loop 160 can be aligned with and passed through an appropriate front shoulder strap attachment opening 113.

When an appropriate front shoulder strap attachment opening 113 has been aligned with the attachment loop 160, the attachment loop 160 is passed through the aligned front shoulder strap attachment opening 113.

Once the attachment loop 160 has been passed through a front shoulder strap attachment opening 113 of a first front shoulder strap element 112, an end of a second front shoulder strap element 112 is passed through an interior tunnel or cavity of the back panel 120 and the attachment loop 160 is passed through an appropriately aligned front shoulder strap attachment opening 113 of the second front shoulder strap element 112.

When the attachment loop 160 has been passed through the desired waist belt attachment openings 141 of the waist belt elements 140 and the desired front shoulder strap attachment openings 113 of the front shoulder strap elements 112, a portion of the release lanyard 115 is passed through the attachment loop 160 to secure the waist belt elements 140 and the front shoulder strap elements 112 to the back panel 120.

In various exemplary embodiments, the release lanyard 115 follows a path that parallels the path taken by one of the front shoulder strap elements 112. To maintain an appropriate position of the release lanyard 115, release lanyard guides, such as, for example, release lanyard guides 114, may be included on various portions of the front shoulder strap elements 112. Alternatively, similar release lanyard guides may be included interior to the back panel 120.

In various exemplary embodiments, the release lanyard 115 is of a sufficient length such that when the releasable lanyard 115 is passed through the attachment loop 160, the pull handle 115' is at least partially covered by a release lanyard cover 116. The release lanyard cover 116 provides at least some measure of security that the release lanyard 115 is not accidentally pulled.

In various exemplary embodiments, at least a portion of the release lanyard 115 includes a frictional surface (not shown). The frictional surface, if included, can provide a certain amount of resistance to the release lanyard 115 being pulled from the releasable vest 100 and/or the release lanyard cover 116, when the releasable vest 100 is fully assembled.

It should be appreciated that the order in which the components of the releasable vest 100 are described as being assembled may be altered so that a user is able to achieve the best fit of the releasable vest 100. For example, the attachment loop 160 may be passed through the waist belt attachment openings 141 and/or the waist belt elements 140 may be releasably coupled to the attachment loop 160 before the waist belt elements 140 are secured to the front panel 110.

When the elements of the releasable vest 100 have been assembled, the assembled releasable vest 100 may be donned or removed by a user utilizing the waist belt attachment/adjustment elements 145. Alternatively, if the waist belt elements 140 are formed integral to the front panel 110, an elastic portion of the waist belt elements 140 may provide sufficient flex to allow the releasable vest 100 to be donned or removed by the user.

If a wearer wishes to quickly remove the releasable vest 100, the releasable lanyard 115 need only be pulled a relatively short distance. When the pull handle 115' of the releasable lanyard 115 is pulled, the release lanyard 115 is slidably pulled from the attachment loop 160, and the waist belt elements 140 and front shoulder strap elements 112 are able to separate from the attachment loop 160, and the back panel 120. Thus, when the pull handle 115' is pulled, the elements of the releasable vest 100 are released and the vest can "fall away" from the body of the user.

In various exemplary embodiments, the releasable vest 100 may utilize a second, or safety lanyard, which may also be slidably passed through the attachment loop 160. The safety lanyard operates similarly to the release lanyard 115. However, the safety lanyard, if utilized, requires that a second obstruction be removed from the attachment loop 160 before the elements of the releasable vest 100 are able to separate from the attachment loop 160.

It should be appreciated that the safety lanyard, if included, may be assembled such that the pull handle for the safety lanyard is positioned proximate the pull handle 115' of the release lanyard 115. Alternatively, the safety lanyard may be assembled such that the pull handle for the safety lanyard is positioned remote from the pull handle 115' of the release lanyard 115. For example, the pull handle for the safety lanyard and the pull handle 115' of the release lanyard 115 may both be positioned near the user's right shoulder. Alternatively, the pull handle for the safety lanyard may be positioned near the user's left shoulder, while the pull handle 115' of the release lanyard 115 may be positioned near the user's right shoulder.

In certain exemplary embodiments, the safety lanyard may comprise a loop of material or a ring, such as, for example, a locking or snap carabineer, that is slidably passed through the attachment loop 160 after the elements of the releasable vest 100 have been slidably releasably coupled to the attachment loop 160. In various exemplary embodiments, release of the safety lanyard may require access through the access panel 124.

It is possible that a safety lanyard be used in place of the release lanyard 115. In this manner, the releasable features and capabilities of the vest are overcome and the elements remain coupled until the safety lanyard is removed.

In various exemplary embodiments, instructions for assembling and/or operating the releasable vest 100 may be included on an inside layer or surface of the access panel 124. In this manner, when the access panel 124 is lifted so that a user has access to the attachment loop 160, instructions for the assembly and/or operation of the releasable vest 100 are provided. The instructions may be provided in written, pictorial, diagram, or a combination of forms.

Alternatively, instructions for assembling and/or operating the releasable vest 100 may be included on the second layer 122 of the back panel 120. The instructions may be provided in written, pictographic, diagram, symbolic, or a combination of forms and may, for example, include a pictorial outline of certain of the components illustrating the relationship of each of the components when assembled or illustrating how the components are to be assembled.

While optional instructions have been described as being included on the inside layer or surface of the access panel 124 or the second layer 122 of the back panel 120, the optional instructions may be included on any covered or exposed surface of any component of the releasable vest 100.

Figure 5A:
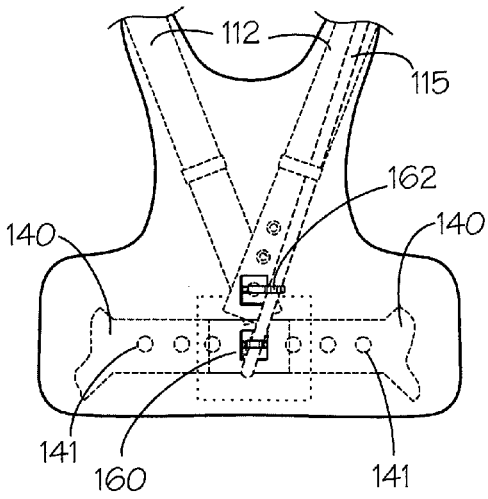
FIG. 5A shows an interior view of the back panel of an exemplary embodiment of a releasable vest according to this invention, where in the releasable vest includes a second attachment loop, according to this invention.
Figure 5B:
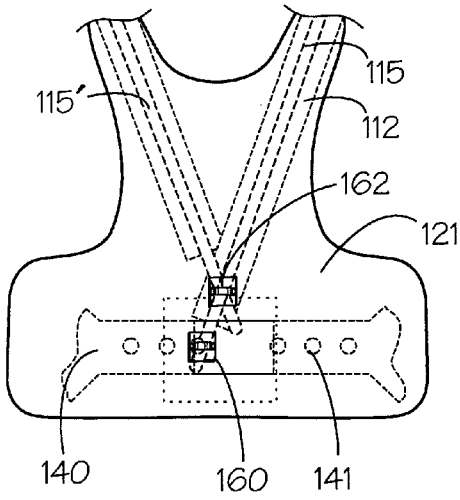
FIG. 5B shows an interior view of the back panel of an exemplary embodiment of a releasable vest according to this invention, where in the releasable vest includes a second attachment loop and a safety lanyard, according to this invention.

FIGS. 5A and 5B show an interior view of the back panel of an exemplary embodiment of a releasable vest, where in the releasable vest includes a second attachment loop 162, according to this invention. As shown in FIGS. 5A and 5B, the releasable vest 100 comprises a first attachment loop 160 and a second attachment loop 162. It should be appreciated that the first attachment loop 160 and the second attachment loop 162 operates similarly to the attachment loop 160, as described above.

However, with the inclusion of the second attachment loop 162, certain components may be releasably coupled to the first attachment loop 160 while certain other components are releasably coupled to the second attachment loop 162. For example, the waist belt elements 140 may be releasably slidably coupled to the first attachment loop 160, while the front shoulder strap elements 112 may be releasably slidably coupled to the second attachment loop 162.

As illustrated in FIGS. 5A and 5B, the releasable lanyard 115 is passed through the first attachment loop 160 and a second attachment loop 162 to secure the front shoulder strap elements 112 and the waist belt elements 140, respectively.

Utilizing a first attachment loop 160 and a second attachment loop 162, when the release lanyard 115 is pulled a first distance, the elements of the releasable vest 100 that are coupled to the first attachment loop 160 are able to separate from the first attachment loop 160 and the back panel 120. Then, when the release lanyard 115 is pulled a second distance, the elements of the releasable vest 100 that are coupled to the second attachment loop 162 are able to separate from the second attachment loop 162 and the back panel 120.

In this manner, certain of the components of the releasable vest 100 are released from the assembled relationship when the release lanyard 115 is pulled a first predetermined distance. When the release lanyard 115 is pulled a second predetermined distance, certain remaining components of the releasable vest 100 are released from the assembled relationship.

If, for example, the release lanyard 115 is accidentally pulled, it is possible that only the waistband elements 140 will be released from the second attachment loop 162, alerting the user to the fact that the release lanyard 115 has been accidentally pulled, before all of the elements of the releasable vest 100 are released from their assembled relationship.

FIG. 5B shows an interior view of the back panel of an exemplary embodiment of the releasable vest 100, wherein a safety lanyard is slidably releasable coupled to the second attachment loop 162. It should be appreciated that the safety lanyard may take a variety of forms, as discussed herein, and may be used to further secure elements coupled to the first attachment loop 160, the second attachment loop 162 (as illustrated), or both the first and the second attachment loops.

Figure 6A:
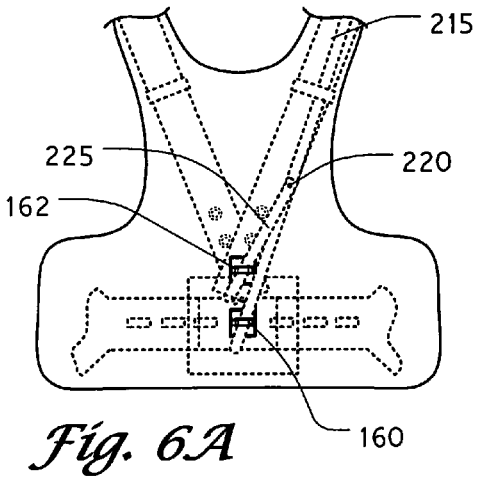
FIG. 6A shows a rear view of the back panel of a second exemplary embodiment of a releasable vest according to this invention.
Figure 6B:
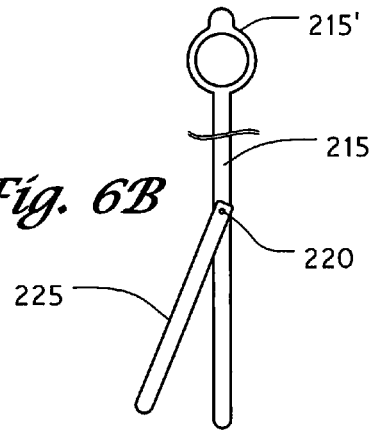
FIG. 6B shows a top view of a second exemplary embodiment of a release lanyard according to this invention.

FIG. 6A shows a rear view of the back panel of a second exemplary embodiment of a releasable vest according to this invention, while FIG. 6B shows a top view of a second exemplary embodiment of a release lanyard 215 according to this invention. As shown in FIGS. 6A and 6B, the release lanyard 215 comprises an elongate piece of material, extending from a pull handle 215', and having a relatively thin profile and operating similarly to the release lanyard 115, as described above.

However, the release lanyard 215 further comprises a pivot arm 225. The pivot arm 225 is pivotably coupled, via a pivot point 220, to the release lanyard 215. The inclusion of the pivot arm 225 allows a main body of the release lanyard 215 to be used to secure elements to, for example, a first attachment loop, while the pivot arm 225 may be used to secure elements to, for example, a second attachment loop.

When the release lanyard 215 is pulled, the pivot arm 225 is able to pivot such that the longitudinal axis of the pivot arm 225 is able to be aligned with the longitudinal axis of the release lanyard 215, thereby providing a relatively compact release lanyard 215.

Figure 7A:
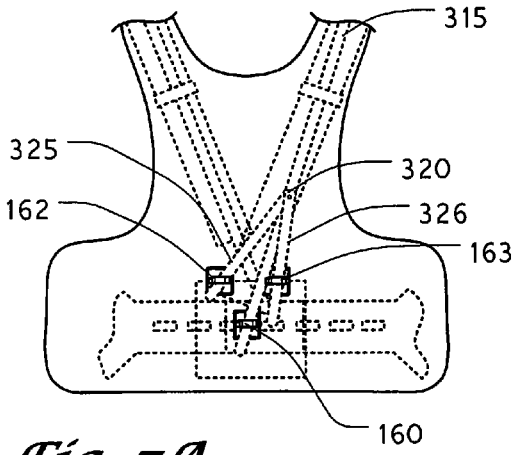
FIG. 7A shows a rear view of the back panel of a third exemplary embodiment of a releasable vest according to this invention.
Figure 7B:
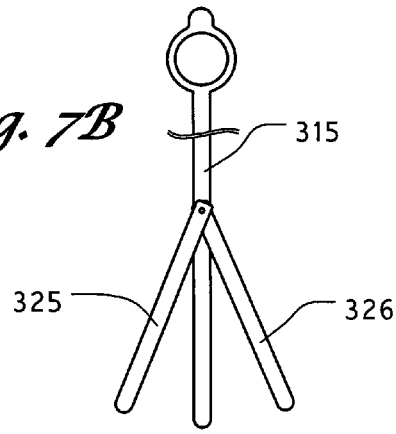
FIG. 7B shows a top view of a third exemplary embodiment of a release lanyard according to this invention.

FIG. 7A shows a partial back view of a back panel of a third exemplary embodiment of a releasable vest according to this invention, while FIG. 7B shows a top view of a third exemplary embodiment of a release lanyard 315 according to this invention. As shown in FIG. 7A, the releasable vest 100 comprises a first attachment loop 160, a second attachment loop 162, and a third attachment loop 163. It should be appreciated that the first attachment loop 160, the second attachment loop 162, and the third attachment loop 163 each operate similarly to the attachment loop 160, as described above.

However, with the inclusion of the second attachment loop 162 and the third attachment loop 163, certain components may be releasably coupled to the first attachment loop 160 while certain other components are releasably coupled to the second attachment loop 162 and still other components are releasably coupled to the third attachment loop 163. For example, the waist belt elements 140 may be releasably slidably coupled to the first attachment loop 160, while a first front shoulder strap element 112 may be releasably slidably coupled to the second attachment loop 162 and second front shoulder strap element 112 may be releasably slidably coupled to the third attachment loop 163.

Alternatively, certain components may be coupled to multiple attachment loops to provide redundant connections.

In various exemplary embodiments, the first attachment loop 160, the second attachment loop 162, and any third attachment loop 163 may be positioned in a relative "V" shape. However, it should be appreciated at the ultimate number and placement of the released loops is a design choice based on the desired appearance and functionality of the releasable vest.

Then, using a release lanyard 315, as illustrated in FIG. 7B, the main body of the release lanyard 315 may be used to secure elements to, for example, a first attachment loop 160, while the first pivot arm 325 may be used to secure elements to, for example, the second attachment loop 162, and the second pivot arm 326 may be used to secure elements to, for example, the third attachment loop 163.

Figure 8:
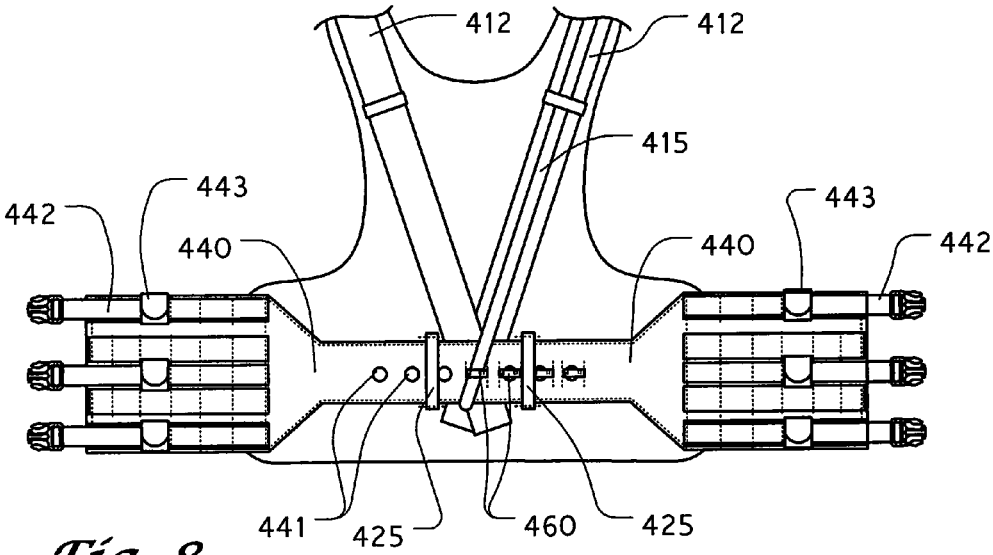
FIG. 8 shows a rear view of a back panel of a fourth exemplary embodiment of a releasable vest according to this invention.

FIG. 8 shows a rear view of a back panel of a fourth exemplary embodiment of a releasable vest according to this invention. It should be understood that the basic elements of the releasable vest 400 correspond to and operates similarly to the basic elements of the releasable vest 100, as described above.

However, as show in FIG. 8, the attachment loop(s) is/are not attached or coupled to the back panel 420 of the releasable vest 400. Instead, at least one attachment loop 460 is attached or coupled to a first waist belt element 440. A second waist belt element 441 includes a plurality of waist belt attachment openings 441. It should be appreciated that the plurality of waist belt attachment openings 441 operate similarly to the plurality of waist belt attachment openings 141.

When the elements of the releasable vest 400 are assembled, at least one attachment loop 460 is passed through a desired waist belt attachment opening 441 of the waist belt element 441 and the desired front shoulder strap attachment openings 413 of the front shoulder strap elements 412. A portion of the release lanyard 415 is then passed through the attachment loop 460 to secure the waist belt element 441 and the front shoulder strap elements 412 to the first waist belt element 440.

Because the at least one attachment loop 460 is not attached or coupled to the back panel 420, one or more securing loops 425 and may be attached or coupled to a portion of the back panel 420. The securing loops 425, if included, allow at least a portion of the waist belt element 440 and/or the waist belt element 441 to be held in a desired position relative to the back panel 420.

It should be appreciated that one or more securing loops 425 may be utilized with the releasable vest 100.

Figure 9:
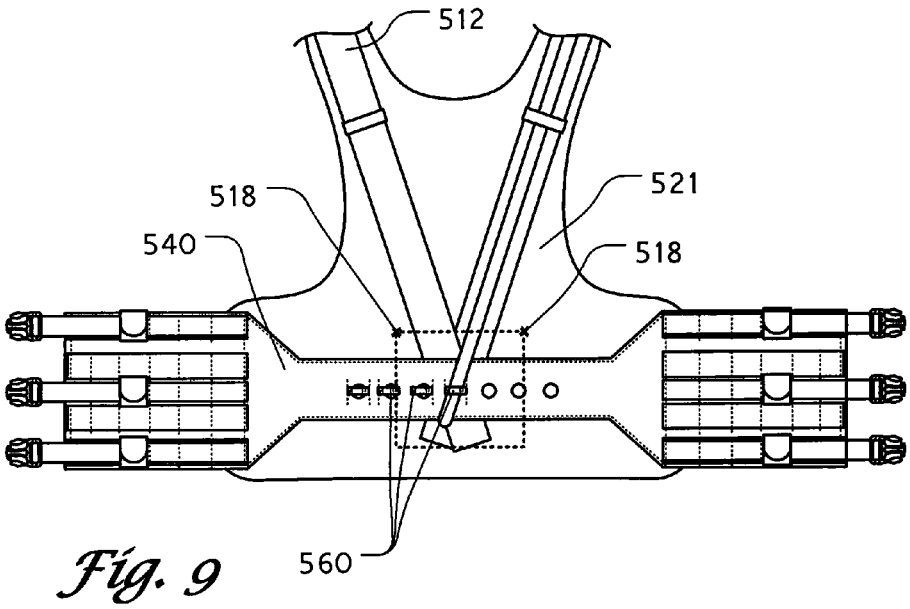
FIG. 9 shows a rear view of a back panel of a fifth exemplary embodiment of a releasable vest according to this invention.

FIG. 9 shows a rear view of a back panel of a fifth exemplary embodiment of a releasable vest according to this invention. It should be understood that the basic elements of the releasable vest 500 correspond to and operates similarly to the basic elements of the releasable vest 400, as described above.

However, as illustrated in FIG. 9 the attachment loops 425 are not utilized. Instead, a portion of the second layer 522 is attached or coupled to a portion of the first layer 521, as illustrated by attachment points 518.

In this manner, when the elements of the releasable vest 500 are assembled, because the at least one attachment loop 560 is not attached or coupled to the back panel 520, the attachment points 518 provide a stop or upper bound to help maintain the waist belt elements 540 in a desired position relative to the back panel 520.

While this invention has been described in conjunction with the exemplary embodiments outlined above, it is evident that many alternatives, modifications, and variations will be apparent to those skilled in the art. Such adaptations and modifications should and are intended to be comprehended within the meaning and range of equivalents of the disclosed exemplary embodiments. It is to be understood that the phraseology of terminology employed herein is for the purpose of description and not of limitation. Accordingly, the foregoing description of the exemplary embodiments of the invention, as set forth above, is intended to be illustrative, not limiting. Various changes, modifications, and/or adaptations may be made without departing from the spirit and scope of this invention.

What is claimed is:

1. A releasable vest comprising:

a first panel;

at least one shoulder strap element that extends from the first panel, wherein the at least one shoulder strap element comprises at least one shoulder strap element attachment opening;

a first waist belt element that extends from the first panel, wherein the first waist belt element comprises at least one waist belt element attachment opening;

a second waist belt element that extends from the first panel, wherein the second waist belt element comprises at least one an attachment loop, wherein the at least one attachment loop is attached to the second waist belt element, wherein the at least one attachment loop is capable of being aligned with and passed through a waist belt attachment opening of the first waist belt element and a shoulder strap element attachment opening of the at least one shoulder strap element;

a second panel, wherein the second panel comprises at least one cavity formed between a first layer and a second layer of the second panel, wherein the at least one cavity is sufficient to allow at least a portion of the shoulder strap elements and the waist belt elements to be introduced into the at least one cavity;

at least one securing loop attached to the second panel such that at least a portion of at least one of the waist belt elements may be passed through the at least one securing loop to maintain the waist belt element in a desired position relative to the second panel; and a release lanyard, wherein the release lanyard comprises an elongate piece of material, and wherein the release lanyard is capable of being aligned with and passed through the at least one attachment loop so as to releasably secure the first waist belt element and the at least one shoulder strap element to the attachment loop.

2. The releasable vest of claim 1, wherein each shoulder strap element is formed as an integral part of the first panel.

3. The releasable vest of claim 1, wherein each shoulder strap element is coupled or attached to the first panel.

4. The releasable vest of claim 1, wherein each shoulder strap element is releasably coupled or attached to the first panel.

5. The releasable vest of claim 1, wherein each shoulder strap element comprises a plurality of shoulder strap attachment openings.

6. The releasable vest of claim 1, wherein the at least one cavity is formed by separated portions of the second panel.

7. The releasable vest of claim 1, wherein the waist belt elements are formed as an integral part of the first panel.

8. The releasable vest of claim 1, wherein the waist belt elements are coupled or attached to the first panel.

9. The releasable vest of claim 1, wherein the waist belt elements are releasably coupled or attached to the first panel.

10. The releasable vest of claim 1, wherein the waist belt elements are releasably coupled or attached to the first panel via waist belt attachment elements.

11. The releasable vest of claim 1, wherein the first panel comprises a spaced apart webbing portion.

12. The releasable vest of claim 1, wherein the second panel comprises a spaced apart webbing portion.

13. The releasable vest of claim 1, wherein the waist belt elements comprises a spaced apart webbing portion.

14. The releasable vest of claim 1, wherein the attachment loop is attached to the second waist belt element by being passed through and captured at least partially within a hole formed in the second waist belt element.

15. The releasable vest of claim 1, wherein the release lanyard has a rectangular profile.

16. The releasable vest of claim 1, wherein the release lanyard has a round or oval shaped profile.

17. The releasable vest of claim 1, wherein access to the attachment loop is provided by an access panel formed in a portion of the second panel.

18. The releasable vest of claim 1, wherein the release lanyard follows a path that parallels a path taken by one of the at least one shoulder strap elements.

19. The releasable vest of claim 1, wherein a pull handle of the release lanyard is at least partially covered by a release lanyard cover.

20. The releasable vest of claim 1, wherein at least one waist belt element includes an elastic portion.

21. The releasable vest of claim 1, wherein the releasable vest further comprises a safety lanyard, which is capable of being aligned with and passed through the attachment loop so as to releasably secure the at least one waist belt element and the at least one shoulder strap element to the attachment loop.

22. The releasable vest of claim 1, wherein a portion of the second layer is attached or coupled to a portion of the first layer, via at least one attachment point, such that the attachment point(s) provide an upper bound to help maintain the waist belt elements in a desired position relative to the second panel.

23. A releasable vest comprising:

a first panel;

at least one shoulder strap element that extends from the first panel, wherein the at least one shoulder strap element comprises at least one shoulder strap element attachment opening;

at least one waist belt element that extends from the first panel, wherein each waist belt element comprises at least one waist belt element attachment opening;

a second panel, wherein the second panel comprises at least one cavity formed between a first layer and a second layer of the second panel, wherein the at least one cavity is sufficient to allow at least a portion of the shoulder strap elements and the waist belt elements to be introduced into the at least one cavity;

an attachment loop, wherein the attachment loop is attached to the second panel within the at least one cavity, wherein the attachment loop is capable of being aligned with and passed through a waist belt attachment opening of at least one waist belt element and a shoulder strap element attachment opening of at least one shoulder strap element;

a second attachment loop, wherein the second attachment loop is attached to the second panel, within the at least one cavity, such that at least a portion of the release lanyard may be aligned with and passed through the second attachment loop so as to releasably secure at least one waist belt element or at least one shoulder strap element to the second attachment loop; and a release lanyard, wherein the release lanyard comprises an elongate piece of material, and wherein the release lanyard is capable of being aligned with and passed through the attachment loop so as to releasably secure the at least one waist belt element and the at least one shoulder strap element to the attachment loop.

24. The releasable vest of claim 23, wherein the releasable vest further comprises one or more securing loops attached to the second panel such that a waist belt element may be passed through a securing loop to maintain the waist belt element in a desired position relative to the second panel.

25. The releasable vest of claim 23, wherein the release lanyard comprises a first release lanyard portion comprising a main body and a second release lanyard portion comprising a pivot arm, wherein the pivot arm is pivotably coupled to the release lanyard, such that the main body of the release lanyard may be aligned with and passed through the attachment loop so as to releasably secure at least one waist belt element or at least one shoulder strap element to the attachment loop and the pivot arm may be aligned with and passed through the second attachment loop so as to releasably secure at least one waist belt element or at least one shoulder strap element to the second attachment loop.

26. The releasable vest of claim 25, wherein the releasable vest further comprises at least two securing loops attached to the second panel such that at least a portion of each of the waist belt elements may be passed through a securing loop to maintain each waist belt element in a desired position relative to the second panel.

27. The releasable vest of claim 23, wherein the releasable vest further comprises a third attachment loop, wherein the third attachment loop is attached to the second panel within the at least one cavity, such that at least a portion of the release lanyard may be aligned with and passed through the third attachment loop so as to releasably secure at least one waist belt element or at least one shoulder strap element to the third attachment loop.

28. The releasable vest of claim 23, wherein the releasable vest further comprises a third attachment loop, wherein the third attachment loop is attached to the second panel within the at least one cavity, and wherein the release lanyard comprises a first release lanyard portion comprising a main body, a second release lanyard portion comprising a pivot arm, wherein the pivot arm is pivotably coupled to the release lanyard, and a third release lanyard portion comprising a second pivot arm, wherein the second pivot arm is pivotably coupled to the release lanyard, such that the main body of the release lanyard may be aligned with and passed through the attachment loop so as to releasably secure at least one waist belt element or at least one shoulder strap element to the attachment loop, the first pivot arm may be aligned with and passed through the second attachment loop so as to releasably secure at least one waist belt element or at least one shoulder strap element to the second attachment loop, and the second pivot arm may be aligned with and passed through the third attachment loop so as to releasably secure at least one waist belt element or at least one shoulder strap element to the third attachment loop.

* * * * *

UNITED STATES PATENT AND TRADEMARK OFFICE

CERTIFICATE OF CORRECTION

PATENT NO. : 8,418,265 B1
APPLICATION NO. : 11/895718
DATED : April 16, 2013
INVENTOR(S) : Frederick W. Storms, Jr., Eric M. Yeates and Thomas A. Marx It is certified that error appears in the above-identified patent and that said Letters Patent is hereby corrected as shown below:

In the Claims:

Claim 1, under Column 11, Line 63, delete "at least one an attachment loop" and insert --at least one attachment loop--.

Signed and Sealed this
Ninth Day of July, 2013

Teresa Stanek Rea
*Acting Director of the United States Patent and Trademark Office*